United States Patent [19]

Caldwell et al.

[11] 4,445,258

[45] May 1, 1984

[54] METHOD OF SEALING INTERFACES OF BEARING SURFACES TO STEEL BARRELS OF PISTON PUMPS

[75] Inventors: George R. Caldwell, Black River; Edward J. Gallagher, Watertown, both of N.Y.

[73] Assignee: General Signal Corporation, Stamford, Conn.

[21] Appl. No.: 342,943

[22] Filed: Jan. 26, 1982

[51] Int. Cl.[3] ..... B22D 19/00

[52] U.S. Cl. ..... 29/156.7 R; 29/156.4 WL

[58] Field of Search ..... 29/156.4 WL, 156.4 R, 29/156.7 R, 527.5, 33 C; 164/80, 98

[56] References Cited

U.S. PATENT DOCUMENTS

| | | | |
|---|---|---|---|
| 1,217,581 | 2/1917 | Eldred | 29/33 C |
| 3,169,488 | 2/1965 | Galliger . | |
| 3,707,034 | 12/1972 | Alger, Jr. et al. . | |
| 3,707,035 | 12/1972 | Alger, Jr. et al. . | |
| 3,709,107 | 1/1973 | Alger, Jr. et al. . | |
| 3,709,108 | 1/1973 | Alger, Jr. et al. . | |
| 3,803,687 | 4/1974 | Alger, Jr. et al. | 29/156.4 WL |
| 3,937,268 | 2/1976 | Loebs et al. | 164/80 X |

*Primary Examiner*—Howard N. Goldberg

*Assistant Examiner*—Carl J. Arbes

*Attorney, Agent, or Firm*—Thomas R. FitzGerald; Harold S. Wynn; Jeffrey S. Mednick

[57] ABSTRACT

The method of contemporaneously sealing interfaces of bearing surfaces for valve faces and cylinder linings in a steel rotary cylindrical barrel having a plurality of longitudinal bores extending through the barrel longitudinally from one end to the other, each of the bores having a restricted diameter intermediate portion connecting a valve surface area at one end of the barrel with a cylinder area extending to the other end. An insert of bearing material is placed in both ends of the bore and a cap secured over a lower end adjoining the cylinder bore. A removable carbon hot top is placed over the other end of the barrel. The barrel and its assembly is heated in a metallurgical furnace for 90 minutes at 1925° F., disposed vertically, with the cap at the bottom and is then removed from the furnace and cooled with the cap resting on a bronze pedestal to cause the bearing material to slowly solidify from the bottom up, and to cause gases to rise through the restricted area of the bore as the barrel cools. When the temperature is below 1000° F., the hot top is removed to permit solidification of the bearing material in the upper valve area.

9 Claims, 2 Drawing Figures

Figure 2:
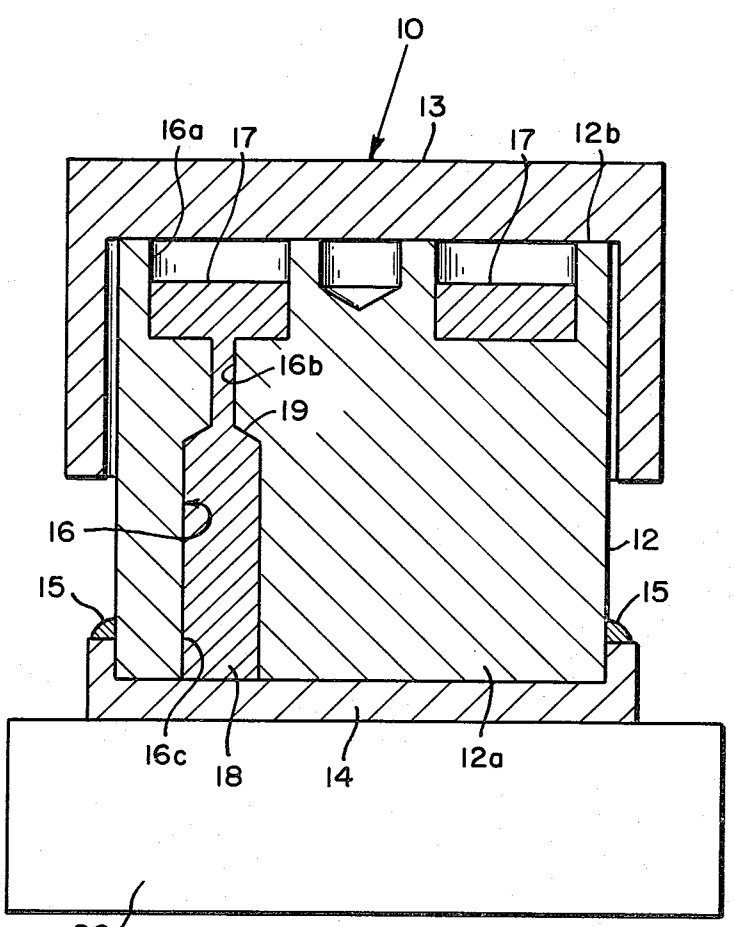

METHOD OF SEALING INTERFACES OF BEARING SURFACES TO STEEL BARRELS OF PISTON PUMPS

REFERENCE TO PRIOR CASES

This invention is related to prior U.S. Pat. Nos. 3,109,488, 3,707,034, 3,707,035, and 3,709,107, assigned to the same assignee as the present invention, these patents being for various methods of bonding bearing material in a steel bore. The Eldred U.S. Pat. No. 1,217,581 is also relevant to the present invention. These patents are in part incorporated herein by reference for defining background material for the present invention.

BACKGROUND OF THE INVENTION

This invention relates to methods for bonding valve face and cylinder bearing interface areas in bores of a steel barrel for multiple piston pumps and it more particularly relates to methods of metallurically bonding bearing material in bores of the steel barrel.

In the use of hydraulic pumps and motors of the rotary cylinder barrel type, such as is disclosed in the Galliger U.S. Pat. No. 3,169,488, high speed and high pressure are both generally required, and thus it is necessary to provide bronze friction surfaces in the bores of a steel cylindrical barrel having multiple bores. A problem in bonding bronze friction surfaces in these bores has been to prevent fluid leakage that can take place if the metallurgical bond between the bronze and the steel is faulty because of gas remaining in the bonding area, for example, during solidification of the bronze bearing material in the bonding process. Therefore in the bonding method of the prior art patents, the construction of the pumps and motors is costly in that there is a high percentage of rejection because of fluid leakage through the bonding joints at high pressure operation.

An object of the present invention is to provide an improved method for bonding bearing material within bores in steel barrels of fluid pumps and motors which substantially obviates one or more of the limitations and disadvantages of the described prior art systems.

Another object of the present invention is to provide a less costly method of constructing hydraulic pumps and motors.

Other objects, purposes and characteristic features of the present invention will be in part obvious from the accompanying drawings, and in part pointed out as the description of the invention progresses.

SUMMARY OF THE INVENTION

A method of contemporaneously bonding cylinder barrel inserts and valve face inserts in a rotary cylindrical barrel is provided for a reciprocating piston pump or motor wherein the motor has a steel cylindrical barrel having a plurality of longitudinal bores therethrough from one end to the other, there being an intermediate portion of the bores that is reduced in diameter, connecting valve face areas and cylinder areas. Bronze bearing material is inserted in the respective areas of each of the bores, and a cap is secured over the cylinder end of the bores to prevent the escape of liquid bronze when treated in a metallurgical furnace. A carbon hot top cap is provided over the other end of the barrel, and the barrel assembly is inserted in a metallurgical furnace with the barrel areas vertical with the cap at the bottom. The barrel assembly is then heated to 1925° F. for 90 minutes to provide metallurgical bonding in the valve face and cylinder areas.

In order to provide a tighter bond of the bronze bearing material to the steel, the cylinder barrel assembly is removed from the furnace after the 90 minute interval and is set on a bronze pedestal to provide a controlled degree of cooling so as to gradually solidify the bronze material from the base cap up to the hot top so as to permit gases to escape upwardly through the liquid bronze, and thus permit a tighter bond between the bronze and the steel. When the steel barrel assembly has cooled to approximately 1000° F., the hot top is removed to permit completion of the solidification of the bronze bearing material by permitting solidification in the upper portion of the valve face area. The restrictive intermediate area in the bores in the steel barrel provide strong steel shoulders to withstand the high fluid pressures that are developed in the piston cylinders, urging the barrel axially against a fixed valve plate to prevent leakage in the valve face area.

For a better understanding of the present invention, together with other and further objects thereof, reference is had to the following description, taken in connection with the accompaning drawings, while its scope will be pointed out in the appending claims.

IN THE DRAWINGS

Figure 1:
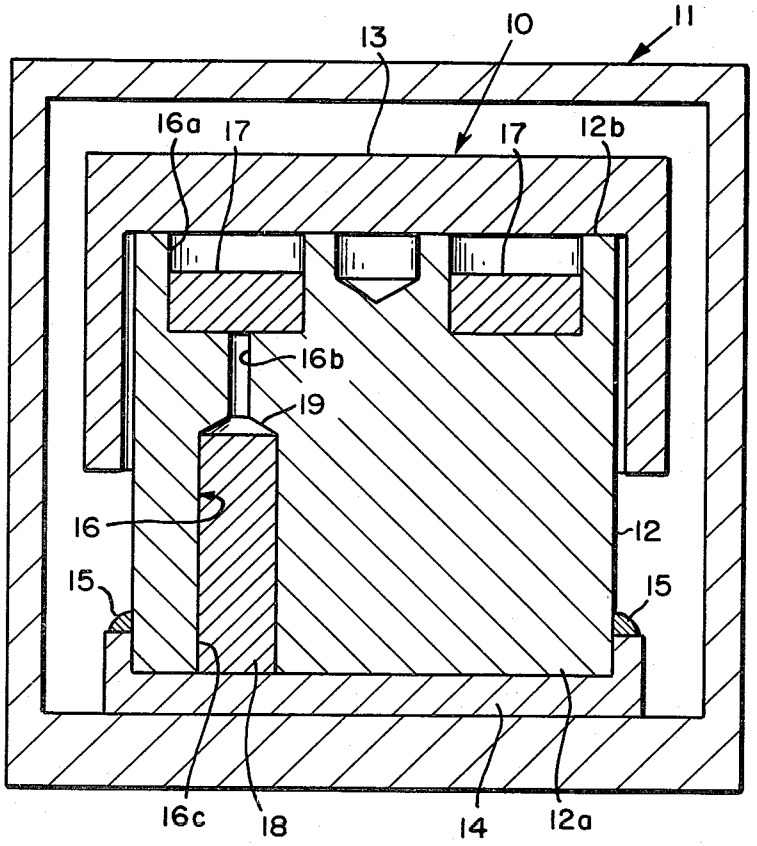

FIG. 1 is an elevational sectional view of a steel barrel assembly within a metallurgical furnace according to a preferred embodiment of the present invention: and FIG. 2 is an elevational view, partly in cross section, of the barrel assembly of FIG. 1 after having been removed from the metallurgical furnace.

With reference to FIG. 1, a steel barrel assembly 10 is shown as being contained in a suitable metallurgical furnace 11. The pump barrel assembly comprises a pump cylinder 12 disposed in axial elevation with a hot top carbon cap resting on the top end thereof, and a base cap 14 secured by welding at 15 over the lower end **12*a* of the barrel 12**.

The steel barrel 12 has a plurality of bores 16 formed therein, spaced about the axis of the cylinder barrel 12, and extending from the lower end **12*a* of the barrel 12 to the upper end 12*b* thereof. Only a typical bore 16 is illustrated in the sectional view of FIG. 1, but it is to be understood that the usual number of bores, such as 9, is provided in the cylinder barrel 12** as is more fully disclosed in the above mentioned prior Galliger U.S. Pat. No. 3,169,488.

Each of the bores 16 has three different steps in diameter, the larger diameter being **16*a* at the top of the barrel in a valve face area, the smaller being an intermediate section 16*b* in a working port area and a lower intermediate diameter bore 16*c*** in a piston cylinder area.

The upper portions **16*a* of the bores 16 contain a slug of bronze bearing material 17 that can be, for example, a washer shaped slug fitted into the bore 16*a* which can be in the form of an annular bore coaxial with the barrel for receiving the bronze slug, which can be in the form of a washer 17. The lower portions of the bores 16*c* have cylindrical inserts of bronze bearing material to provide, after machining, bronze cylinders for containing pump pistons (not shown). The pump pistons will extend through the lower ends of the cylinder portion 16*c*. The intermediate portion 16*b* of the bore 16 is of reduced diameter, wherein a steel shoulder 19** is formed to withstand the high fluid pressure developed by the pump pistons (not shown), acting axially in the bore in an upward direction.

In heat treating the barrel assembly, the furnace is first heated to 1925° F., and then the barrel assembly 10 is placed in the furnace in the upright position illustrated in FIG. 1 and allowed to remain in the furnace for approximately 90 minutes after the furnace temperature returns to 1925° F. Upon termination of the heat treat period of 90 minutes, the assembly 10 is removed from the furnace and placed on a bronze pedestal 20 for cooling (see FIG. 2). The barrel assembly 10 cools from the cap 14 upwardly at a gradual rate, governed by the heat-sink character of the bronze pedestal 20 so that the bronze bearing material solidifies at a controlled rate starting from the lower end 12*a* of the barrel 12, thus the bronze bearing mateial solidifies at a controlled rate starting from the base of the barrel assembly 10 upwardly. In this manner, the solidification of the bearing material drives off gases which rise through the above liquid bearing material and reach the atmosphere through the reduced bore portions 16*b* and the larger bore portions 16*a*, which provides a tighter metallurgical bond than would be provided if the gas could not escape.

After the assembly 10 has cooled to approximately 1000° F., the hot top 13 is removed, and solidification of the bearing portion at the upper end of the barrel 12 is permitted to complete the solidification of the bearing material.

It will be noted that the gases are driven off by the weight of the liquid bearing material in the bores 16, there being a greater pressure formed by the weight of the liquid bearing material at the bottom of the assembly, and the pressure decreases as solidification of the bearing material progresses to the point where there is little weight of the liquid material to drive off gases when solidification takes place at the top of the cylinder 12, after removal of the hot top 13. Voids in the upper surface of the bores 16 are taken care of, however, by making a generous allowance for the machining down of the upper valve surface of the barrel end 12*b*, this being machined down, for example, to thickness of the bronze bearing material in the annular bore 16*a* to approximately 0.02 inches thick.

Having thus described a method for bonding bearing material within a steel cylinder barrel for a pump as a preferred embodiment of the present invention, it is to be understood that various modifications and alterations may be made to the specific embodiment shown, without departing from the spirit or scope of the invention.

What is claimed is:

1. The method of contemporaneously sealing cylinder barrel inserts and valve face inserts of bearing material in a rotary cylindrical barrel for a reciprocal piston pump or motor wherein the cylinder barrel, after machine finishing, will have a valving face at one end and an opposite end face from which pistons project from machined cylinder inserts comprising the steps of:

(a) fabricating a steel barrel blank having a series of longitudinal bores which extend through the blank longitudinally from one end to the other, said bores having an intermediate restricted diameter portion for connecting a valve face area at one end of the blank with a cylinder area at the other end thereof, (b) inserting cylindrical inserts of bearing material within the cylinder area, (c) inserting valve face bearing material in the valve face area, (d) securing a metal cap over the cylinder area to prevent leakage of bearing material from the cylinder area, (e) covering the valve face area with a carbon hot top for controlling the cooling of the valve area after removal of the barrel from a metallurgical furnace, (f) heating the steel barrel blank, disposed vertically in the furnace with the cylinder and valve bearing materials both inserted, and the metal cap at the bottom of the steel barrel and the hot-top on the top of the steel barrel, for a heating period of approximately 90 minutes at approximately 1925° F., (g) removing the steel barrel blank from the furnace at the end of the heating period when the cylinder and valve bearing materials are both in a molten state, with the barrel blank still assembled with the cap at the bottom and the hot top on top and placing it on a heat-sink pedestal to cool, and (h) removing the hot top after the barrel has cooled to below 1000° F., (i) whereby the restricted portion in the bores connecting the valve area with the cylinder area allow for venting and out-gassing of the cylinder bores as well as feeding the cylinder bores with molten metal from the valve face area as solidification takes place gradually of the bearing material from the bottom to the top of the barrel at a controlled rate.

2. The method of contemporaneously sealing cylinder barrel inserts and valve face inserts of bearing material in a rotary cylindrical barrel according to claim 1 wherein the intermediate restricted diameter portion in the bore is large enough to permit degassing to take place in the cylinder area as the bearing material in the cylinder area cools and forms a metallurgical bond with the bore of the steel barrel.

3. The method of contemporaneously sealing cylinder barrel inserts and valve face inserts of bearing material in a rotary cylindrical barrel according to claim 2 wherein the intermediate restricted diameter portion of the bore in the steel barrel is small enough in diameter to prevent blow-out of bearing material in response to high pressures formed in the piston cylinder areas.

4. The method of contemporaneously sealing cylinder barrel inserts and valve face inserts of bearing material in a rotary cylindrical barrel according to claim 3 wherein solidification of the bearing material and degassing takes place throughout the working area of the barrel before the hot top is removed, and any imperfections in bonding of the bearing material that solidifies after the removal of the hot top is near the upper end of the barrel and is machined away in a finishing process.

5. The method of contemporaneously sealing cylinder barrel inserts and valve face inserts of bearing material in a rotary cylindrical barrel blank for a reciprocal piston pump or motor wherein the cylinder barrel, after machine finishing, will have a valving face at one end and an opposite end face from which pistons project from machined cylinder inserts the barrel blank having a series of bores extending longitudinally from one end to the other, said bores having an intermediate restricted diameter portion for connecting a valve face area at one end of the blank with a cylinder area at the other end thereof, comprising the steps of:

(a) inserting cylinder bearing material within the cylinder area, (b) inserting valve face bearing material in the valve face area, (c) securing a metal cap over the cylinder area to prevent leakage of bearing material from the cylinder area, (d) covering the valve face area with a carbon hot top for controlling the cooling of the valve area after removal of the barrel from a metallurgical furnace, (e) heating the steel barrel blank assembled with the metal cap at the bottom and the hot-top on the top thereof within the furnace for a predetermined time interval and at a sufficient temperature to enable the formation of a metallurgical bond between the inserted bearing material and the cylinder barrel and valve face, and (f) removing the steel barrel blank assembled with the cap at the bottom and the hot top on top from the furnace after the interval and placing it on a heat-sink pedestal to cool, (g) whereby the restricted portion in the bores connecting the valve area with the cylinder area allow for venting and out-gassing of the cylinder bores as well as feeding the cylinder bores with molten metal from the valve face area as solidification takes place gradually of the bearing material from the bottom to the top of the barrel at a controlled rate.

6. The method of claim 5 wherein the hot top is not removed from the barrel until the barrel has cooled to 1000° F.

7. The method of claim 5 wherein the hot top remains on the barrel until the barrel cools to room temperature.

8. The method of claim 5 wherein the predetermined time is approximately 90 minutes.

9. The method of claim 5 wherein the predetermined temperature is approximately 1920° F.

* * * * *